US006276950B1

(12) United States Patent
Yodogawa

(10) Patent No.: US 6,276,950 B1
(45) **Date of Patent: *Aug. 21, 2001**

(54) SOCKET FOR PRINTED CIRCUIT BOARD

(75) Inventor: Akihiro Yodogawa, Fujisawa (JP)

(73) Assignee: Berg Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/849,306

(22) PCT Filed: Dec. 20, 1995

(86) PCT No.: PCT/US95/16662

§ 371 Date: May 5, 1997

§ 102(e) Date: May 5, 1997

(87) PCT Pub. No.: WO96/19849

PCT Pub. Date: Jun. 27, 1996

(30) Foreign Application Priority Data

Dec. 21, 1994 (JP) ..... 6-318142

(51) Int. Cl.[7] ..... H01R 13/62
(52) U.S. Cl. ..... 439/160
(58) Field of Search ..... 439/155, 157, 439/160

(56) References Cited

U.S. PATENT DOCUMENTS

| | | | |
|---|---|---|---|
| 4,898,540 | 2/1990 | Saito | 439/153 |
| 5,211,568 | 5/1993 | Yamada et al. | 439/157 |
| 5,226,833 | 7/1993 | Lwee | 439/326 |
| 5,302,133 | 4/1994 | Tondreault | 439/157 |
| 5,364,282 | 11/1994 | Tondreault | 439/157 |
| 5,413,497 | 5/1995 | Lwee | 439/328 |
| 5,445,531 * | 8/1995 | Billman et al. | 439/160 |
| 5,470,240 | 11/1995 | Suzuki | 439/157 |
| 5,470,242 * | 11/1995 | Cheng et al. | 439/157 |
| 5,672,072 | 9/1997 | Avai | 439/377 |

FOREIGN PATENT DOCUMENTS

WO 90/04272 10/1988 (WO) .

* cited by examiner

*Primary Examiner*—Brian Sircus
*Assistant Examiner*—Javad Nasri
(74) *Attorney, Agent, or Firm*—Brian J. Hamilla; M. Richard Page; Steven M. Reiss

(57) ABSTRACT

A socket for a printed circuit board wherein the attachment and detachment of a printed circuit board can be easily and reliably performed without damaging the printed circuit board. The socket comprising a pair of guide portions extending from a header portion having an insertion opening which receives a printed circuit board to guide the sides of the printed circuit board in its extraction direction, an eject lever arranged at the guide portion to extract one end of the board from the insertion opening, and an elastic guide arm arranged at the guide portion to guide an end surface of the other of the board. When the eject lever extracts one end of the printed circuit board from the insertion opening, the guide arm rotates the board between the pair of guide portions.

14 Claims, 4 Drawing Sheets

SOCKET FOR PRINTED CIRCUIT BOARD

BACKGROUND OF THE INVENTION

This invention relates to a socket for a printed circuit board into which an edge portion of a printed circuit board is directly inserted to directly form a connector.

Direct-type connectors of various types have been developed in accordance with the recent high-density mount.

Generally, such a connector has a header portion having a plurality of spring contacts. The spring contacts are arranged in a housing made of an insulating material and forming a socket. The contact portions of the spring contacts are projected into an insertion opening for a printed circuit board which is called a daughter board. These contact portions form contact rows arranged at predetermined intervals in the axial direction of the insertion opening. A clearance for fitting the edge portion of the printed circuit board is formed between the contact rows.

To hold the respective contact portions, the insertion opening sides have grooves which are alternately arranged at predetermined intervals, at a pair of opposed walls forming the insertion opening of the header portion. The tops of the contact portions project from the grooves, retreating in the grooves and applying a spring force to the edge portion. The contact portions can come back to their initial positions when the edge portion of the printed circuit board is fitted in the insertion opening. For this reason, the contact portions of the spring contacts certainly contact the contact portion of the printed circuit board and hold the printed circuit board at the header portion by an entire spring force of the spring contacts.

To reliably introduce the edge portion of the printed circuit board into the insertion opening of the header portion, a pair of guide portions are arranged close to both longitudinal ends of the insertion opening. The guide portions guide three surfaces of the printed circuit board along the sides thereof and prevent the edge portion and the header portion from being aligned erroneously.

When the printed circuit board is fitted in the socket, the guide portion guides the three surfaces along the both sides of the printed circuit board. The top edge portion of the printed circuit board is inserted, at a desired attitude and in a desired position, into the insertion opening. Since the contact portions of the spring contacts work as resistors to the edge portion inserted in this manner, the printed circuit board needs to be pushed down with a very strong force against the urging force of the spring contacts. However, since the printed circuit board is guided by the guide portions, it can be reliably pushed down at its predetermined position, without causing erroneous alignment, even when it is pushed with such a strong force.

On the other hand, it is considerably difficult to extract the printed circuit board from a connector of this direct-mode type. This is because the printed circuit board is strongly held between the contacts of the spring contacts, and also because those portions of the board which can be held are limited to a narrow range. Since internal spaces of electronic instruments using such a connector are very limited, particularly due to the mount density increased recently, an eject mechanism for extracting a printed circuit board is desired. In fact, a connector has been developed which incorporates an eject mechanism.

Generally, a printed circuit board is guided between a pair of guide portions. It needs to be extracted parallel with the guide portions. Eject mechanisms are therefore provided at both guide portions for guiding the sides of the printed circuit board.

However, when eject mechanisms are provided at a pair of guide portions, respectively, the connector becomes complicated in structure and comes to have a large size. In order to extract the printed circuit board in parallel, the eject mechanisms must be operated simultaneously. If one eject mechanism is operated prior to the other, the printed circuit board will be inclined between the guide portions. In the worst case, the board will be fixed between the guide portions and will no longer be able to be extracted without difficulty.

This invention has been made in consideration of the above matter. Its object is to provide a simple socket for a printed circuit board, in which the board can be reliably fitted and from which the board can be easily and readily extracted by a simple operation.

SUMMARY OF THE INVENTION

A socket for a printed circuit board, according to this invention comprises: a header portion having an insertion opening provided between a pair of opposing walls, for allowing a plurality of contacts to project and for receiving the printed circuit board; a pair of guide portions extending from portions close to longitudinal ends of the insertion opening of the header portion, for guiding sides of the printed circuit board in the inserting and extracting direction thereof; and eject lever arranged at one of the guide portions, for extracting one end of the printed circuit board from the insertion opening; and an elastic guide arm arranged at the other guide portion, for guiding a side of the other end of the printed circuit board. In the socket, the eject lever extracts one end of the printed circuit board from the insertion opening, the guide arm is pressed and deflected on the side of the other end of the printed circuit board, to allow the printed circuit board to rotate between the pair of guide portions.

It is preferable that the guide portions comprise a pair of walls extending in the inserting and extracting direction of the printed circuit board, a pair of guide rails extending from the walls in opposite directions to guide the sides of the printed circuit board, and an eject lever container arranged outside the guide rails between the walls. It is also desirable that the eject lever comprise an operation portion axially coupled to the walls in the eject lever container and a hook portion provided on a header side of the operation portion to extract the printed circuit board from the insertion opening when the operation portion is rotated.

It is preferable that the eject lever have swelling portions projection from the operation portion toward the walls. The swelling portions are held by protruding portions which projects from the walls in the opposite directions when the printed circuit board is fitted in the insertion opening.

Further, it is preferable that the pair of guide rails form a guide groove communicating with the insertion opening and guiding three surface along the sides of the printed circuit board, extend along part of the walls and restrict the angle through which the eject lever is rotated. It is also desirable that the other guide portion comprise a pair of walls extending in the inserting and extracting direction of the printed circuit board and defining a gap containing the guide arm, and a pair of guide rails projecting from the walls in the opposite directions and forming, together with the guide arm, a guide groove communicating with the insertion opening.

The other guide portion comprises a connection wall connecting the walls at the side remote from the guide groove, and a clearance is formed between the connection wall and the guide arm.

In the socket for a printed circuit board, according to the invention, a pair of guide portions guides its side when the printed circuit board is fitted. Even if great force is applied as an edge portion of the printed circuit board is inserted into the insertion opening against an urging force of the spring contacts, the guide portions guide both sides of the board, respectively. The printed circuit board is thereby reliably guided to a predetermined position without causing any erroneous alignment. To extract the board, the eject lever provided at one of the guide portions is operated, extracting and one end of the printed circuit board from the insertion opening. At this time, the other end of the printed circuit board remains fitted in the insertion opening. Hence, the guide arm of an elastic structure arranged at the other guide portion is deflected while pressed at the other side of the board. The guide arm is then rotated between the pair of guide portions. No unnecessary force is applied between the printed circuit board and the guide portions, and the force the spring contacts applies to the printed circuit board whose one end is extracted from the insertion opening is reduced by half since one end of the board has already been extracted. The entire board can be easily extracted from the insertion opening.

One of the guide portions may have an eject lever container located between a pair of walls and adjacent to a pair of guide rails. In this case, the eject lever is compactly arranged in the eject lever container.

When swelling portions projecting from the operation portion are held by the portions projecting from the walls, the eject lever is contained between a pair of wall portions, even if the printed circuit board is not fitted.

A pair of guide rails may form a guide groove for guiding three surfaces along the sides of the printed circuit board, extending along parts of the walls and restricting the rotary range of the eject lever. If so, the guide rails accurately guide the sides of the printed circuit board, and the eject lever is always rotated in a predetermined range. The other guide portion may have a pair of guide rails extending from a pair of wall portions and forming a guide groove together with the guide arm. In this case, the printed circuit board is guided between the guide rails and rotated stably.

Moreover, when the other guide portion has a connection wall for connecting the pair of wall portions and a clearance is formed between the connection wall and the guide arm, the guide arm is prevented from being significantly deformed and further protected from damage resulting from contact members.

DETAILED DESCRIPTION

FIGS. 1 to 5 show a socket 10 for a printed circuit board according to an embodiment of the invention.

Figure 1:
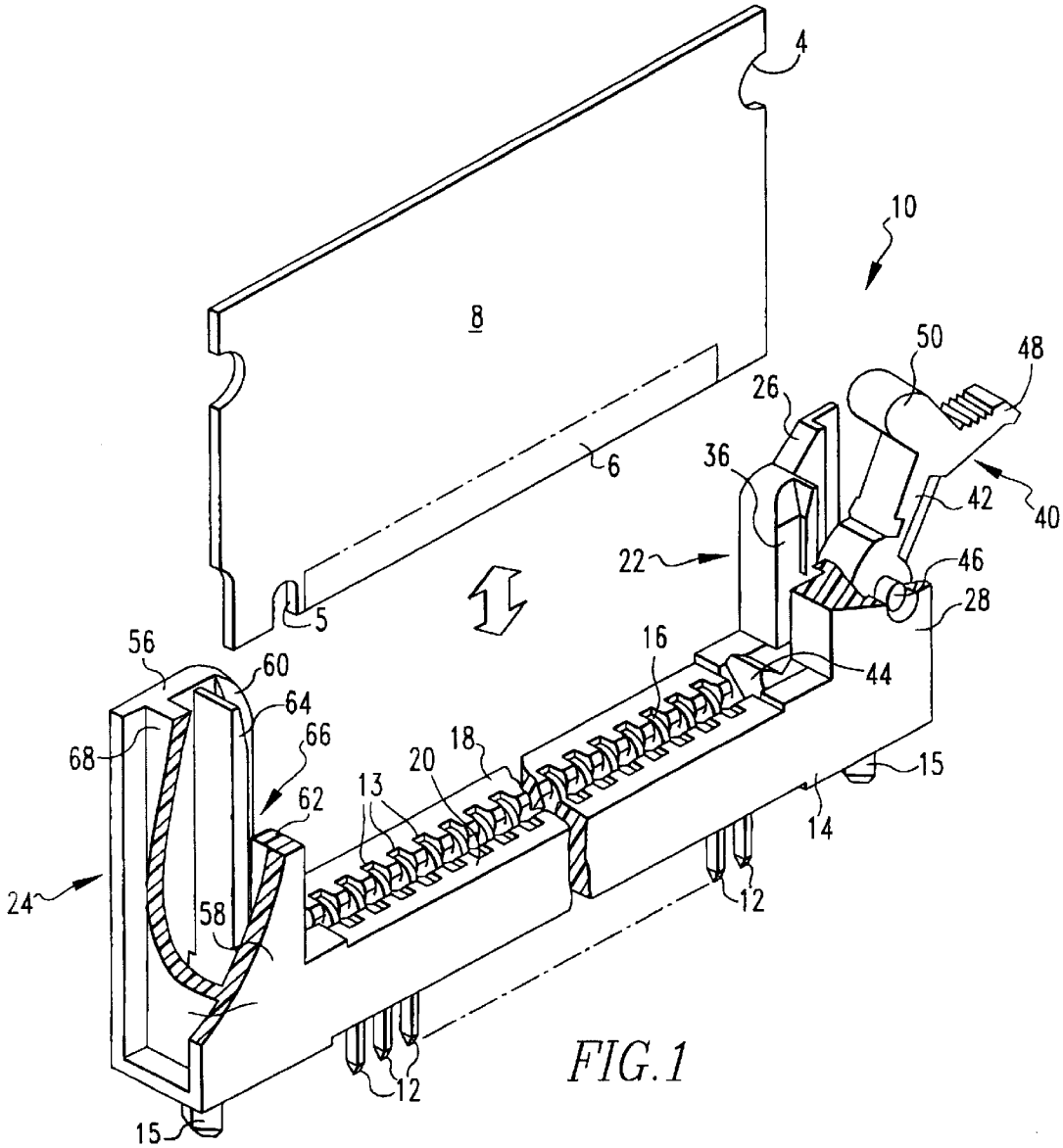
FIG. 1*a* schematic and partially cutaway view showing a socket for a printed circuit board according to an embodiment of this invention.

As shown in FIG. 1, the socket 10 comprises a header portion 14 at which a plurality of spring contacts 12 are arranged at the contact pitches. An insertion opening 16 is formed at the center of the header portion 14, for receiving an edge portion 6 of a printed circuit board 8. The socket 10 is designed to fit, in an upright position, on a surface of a mother board not shown, with the insertion opening 16 opening to the upper side. The foot portions 15 for positioning and fixing project downward from the header portion 14, thus positioning and fixing the socket 10.

Grooves 13 accommodating the spring portions of the spring contacts 12 are alternately formed in a pair of opposing walls 18 and 20 which form the insertion opening 16 at the header portion 14. The grooves 13 formed in each of the walls 18 and 20 open into the insertion opening 16. Contact portions supported by the spring portions project from the grooves 13 into the insertion opening 16, are electrically connected to contact portions aligned at the edge portion 6 inserted into the insertion opening 16, and form contact rows for mechanically holding the printed circuit board 8 at the socket 10.

Bottom portions of the respective grooves 13, i.e. surface portions opposing the insertion opening 16, are arranged with a clearance between them and the spring portions. Owing to this clearance, the spring portions are displaced when the edge portion 6 is inserted into the insertion opening 16. The edge portion 6 mechanically holds the printed circuit board 8. An electric contact to the edge portion 6 is secured due to the force which the spring portions exert as they tend to return to their initial positions. Reference numeral 5 denotes a groove holding a polar key formed at the header portion 14, which prevents an erroneous insertion of the printed circuit board 8. Reference numeral 4 denotes an engagement groove for holding a protruding portion for engagement of an eject lever, which will be described in the following.

A pair of guide portions 22 and 24 extend from both side edges in the longitudinal direction of the insertion opening 16, so as to guide the sides of the printed circuit board 8.

Figure 2A:
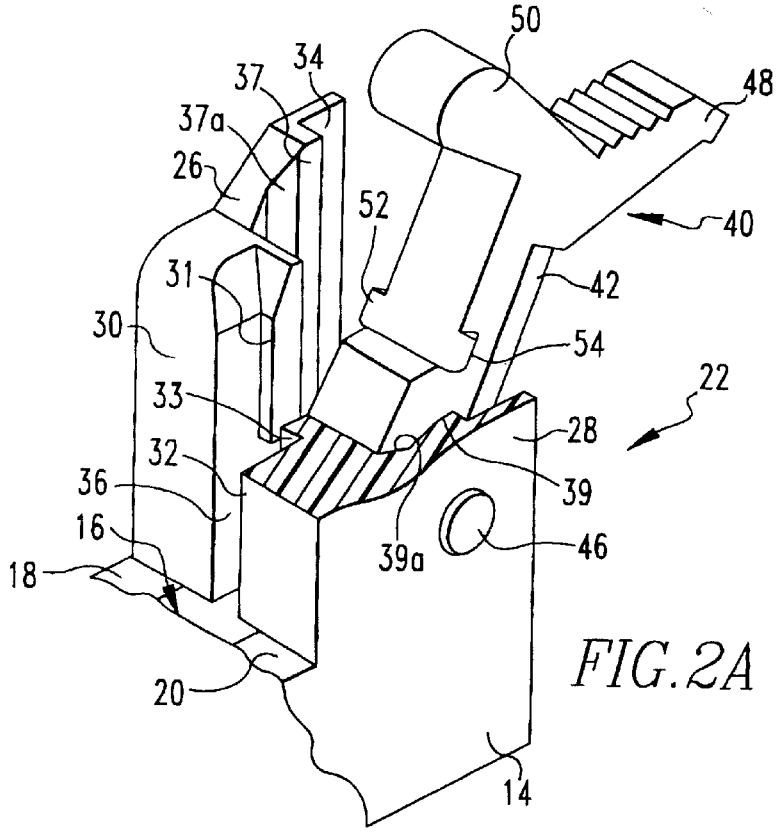
FIGS. 2A and 2B respectively a partially cutaway plan view showing an inclined state of an eject lever of the socket in FIG. 1.
Figure 2B:
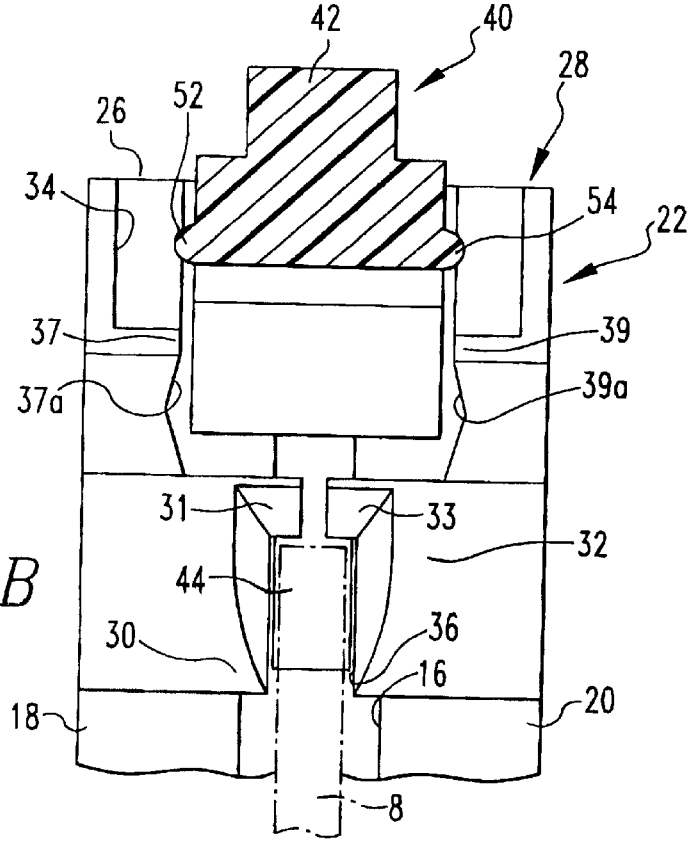
Figure 3A:
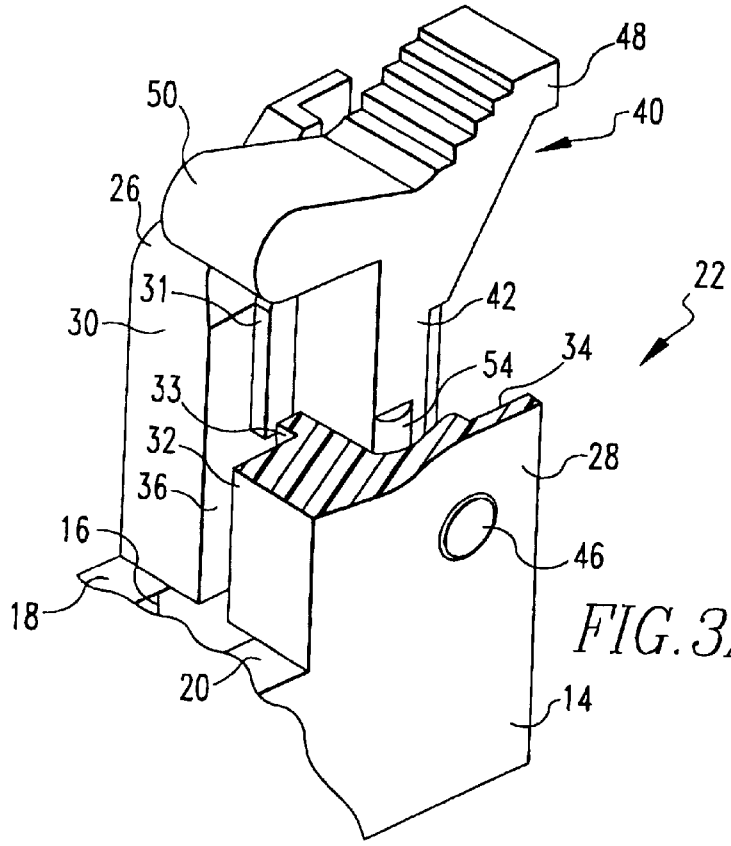
FIGS. 3A and 3B respectively a partially cutaway and plan view showing an upright state of the eject lever of the socket in FIG. 1.

As shown enlarged in FIGS. 2 and 3, the guide portion 22 has a pair of walls 26 and 28 extending in the insertion and extraction direction of the printed circuit board 8. A pair of guide rails 30 and 32 project from the walls 26 and 28 in directions opposing each other. An eject lever container 34 is provided outside the guide rails 30 and 32, i.e. at a side opposite to the insertion opening 16, for containing an eject lever 40.

The guide rails 30 and 32 define a guide groove 36 between them. The guide groove 36 communicates with the insertion opening 16 and guides the printed circuit board 8 along the sides thereof. More precisely, the groove 36 guides three surfaces of the board 8, i.e., two broad surfaces on which circuits and electronic elements such as memories, etc. are arranged, and a narrow end surface of the board 8. Small guide pieces 31 and 33 further project from the guide rails 30 and 32, respectively. The guide rails 30 and 32 have inclined surfaces on their upper portions. Similarly, the guide pieces 31 and 33 have inclined surfaces. All these inclined surfaces define a flaring upper portion of the guide groove 36, facilitating the insertion of the printed circuit board 8. The guide pieces 31 and 33, which can guide the narrow end surface of the printed circuit board 8, need not be extended along the entire lengths of the guide rails 30 and 32, respectively. They may be provided at their part as shown in FIG. 2(A).

Figure 4:
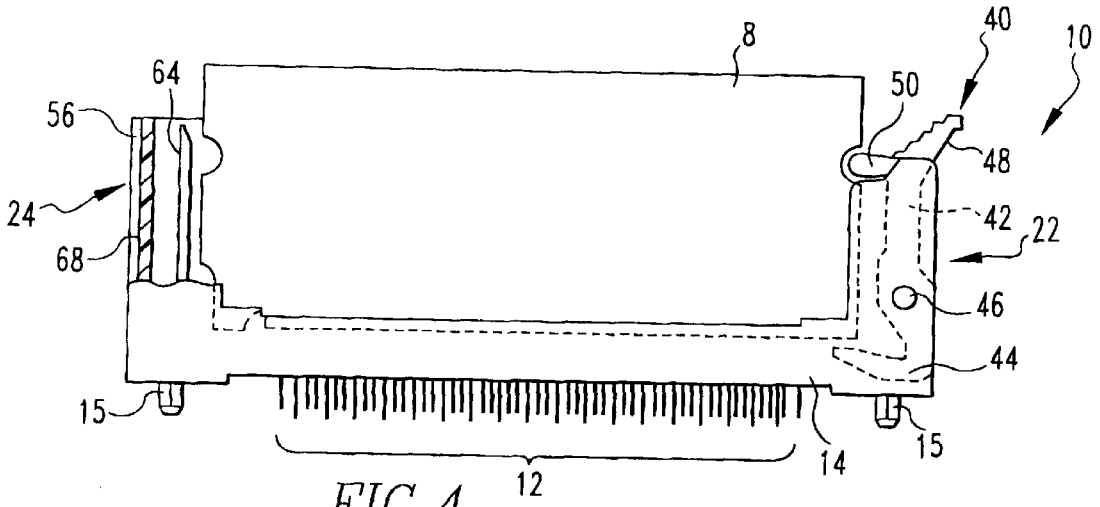
FIG. 4 an explanatory view showing a state of fitting a printed circuit board to the socket in FIG. 1.
Figure 5:
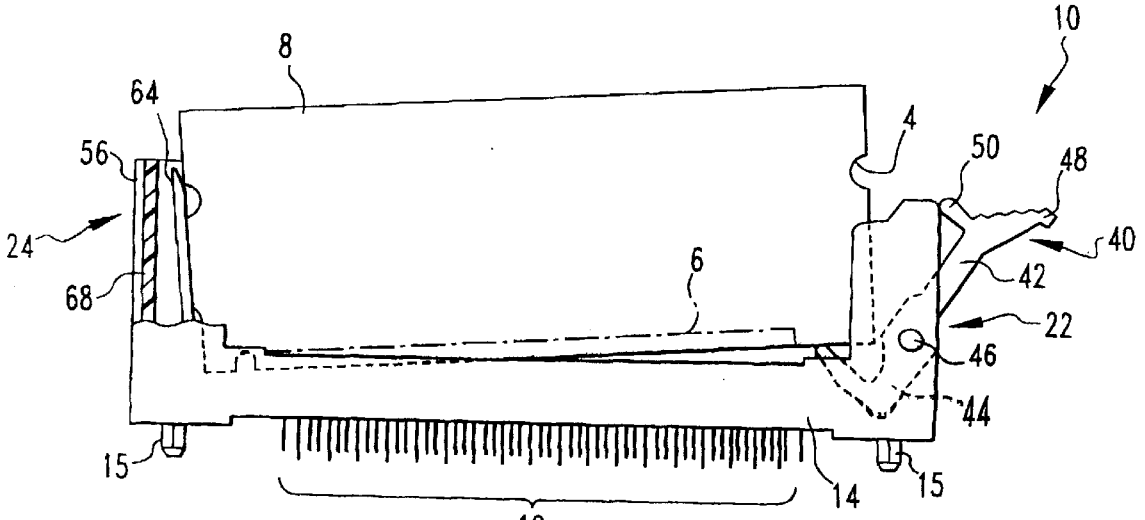
FIG. 5 an explanatory view showing a state of extracting the printed circuit board.

The eject lever 40 contained in the eject lever container 34 has an operation portion 42 and a hook portion 44 arranged at a lower end of the operation portion 42. The eject lever 40 is rotatably connected to the walls 26 and 28 by a shaft 46 provided at the operation portion 42. The eject lever 40 can rotate but between an inclined position shown in FIG. 2 and an upright position shown in FIG. 3. When the lever 40 is at the inclined position (FIG. 2), the operation portion 42 abuts on the lower ends of the guide rails 30 and 32. At the same time, the hook portion 44 projects into the insertion opening 16 (FIG. 5). When the eject lever 40 is in the upright position shown in FIG. 3, the operation portion 42 abuts on the opposing surfaces of the guide rails 30 and 32. At the same time, the hook portion 44 is arranged in the eject lever container 34 (FIG. 4) provided for accommodating the eject lever 40.

In order to rotate the eject lever 40, a finger hook portion 48 is provided at the top of the operation portion 42, and a projection 50 is provided at the side opposite to the finger hook portion 48, to be held in the engagement groove 4 (FIG. 1) of the printed circuit board. The finger hook portion 48 and the projection 50 project more significantly upward than a pair of walls 26 and 28 of the guide portion 22. Hence, they can be easily operated by a hand. A top of the finger hook portion 48 is positioned at almost the same height as that of the other guide portion 24 (FIG. 4).

Further, as clarified in FIGS. 2 and 3, swelling portions 52 and 54 project from the operating portion 42 of the eject lever 40 toward the walls 26 and 28. Protruding portions 37 and 39 project from the walls 26 and 28 into the eject lever container 34. Grooves 37*a* and 39*a* are formed at the sides of the guide rails 30 and 32 of the protruding portions 37 and 39, for containing the swelling portions 52 and 54 of the eject lever 40 and for holding the eject lever in the upright position shown in FIG. 3.

Figure 3B:
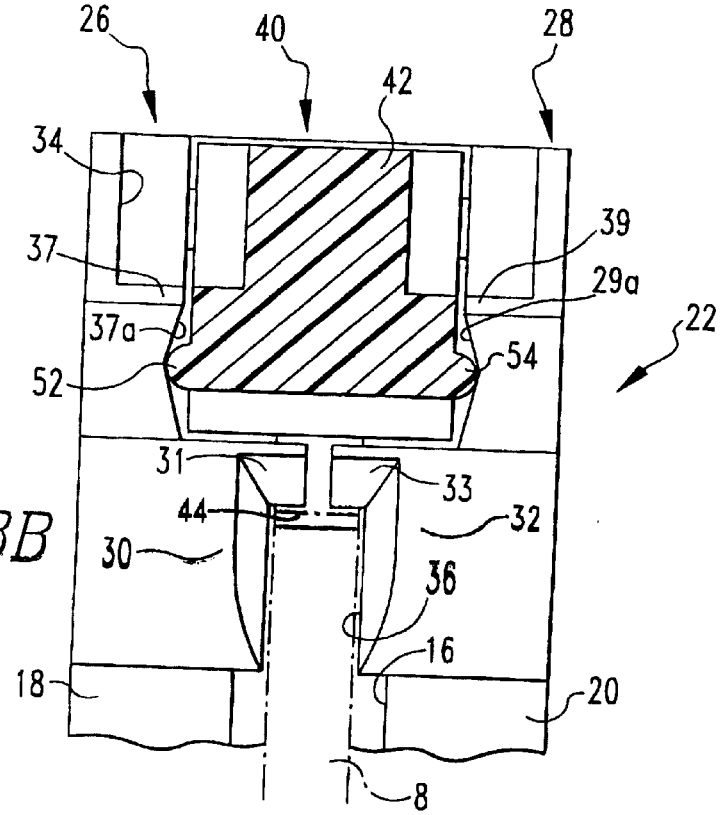

The swelling portions 52 and 54 of the eject lever 40, set in engagement with the protruding portions 37 and 39, are formed in a curved shape. Hence, if the protruding portions 37 and 39 are pressed via the swelling portions 52 and 54, the walls 26 and 28 will be bent in a direction remote from each other, and the swelling portions 52 and 54 will move over the protruding portions 37 and 39. The holding grooves 37*a* and 39*a* for containing these swelling portions 52 and 54 are defined, each by two inclined surfaces intersecting with each other as shown in FIGS. 2(B) and 3(B). The swelling portions 52 and 54 can therefore be automatically held at their central positions or the intersection of the inclined surfaces. When rotated to the upright position from the inclined position shown in FIG. 2, the eject lever 40 can be moved smoothly.

As shown in FIG. 1, the guide portion 24 opposing the guide portion 22 has a pair of walls 56 and 58 which extend in the insertion and extraction direction of the printed circuit board 8. Guide rails 60 and 62 project from the sides of the walls 56 and 58, which are close to the insertion opening 16, in directions opposing each other. A guide arm 64 of an elastic structure is arranged between a pair of the walls 56 and 58 of the guide portion 24. The lower of the arm 64 is combined with the walls 56 and 58. The guide arm 64, and guide rails 60 and 62 define a guide groove 66 for guiding the side of the board 8 which is close to the groove 5. The guide groove 66 communicates with the insertion opening 16 of the header portion 14. The guide rails 60 and 62 guide the wide surfaces of the printed circuit board 8 inserted into the socket 10, whereas the arm 64 guides the narrow end surface of the board 8.

Further, a connection wall 68 connects the walls 56 and 58 of the guide portion 24 together, at their sides remote from the insertion opening 16. A clearance is formed between the connection wall 68 and arm 64, whereby the arm 64 can freely bend, due to its elastic force, to protect the arm 64 from the damage caused by an external force.

An operation of the socket 10 according to this embodiment will be explained with reference to FIGS. 1, 4 and 5.

When the printed circuit board 8 is inserted, the eject lever 40 is set in the inclined position, and the projection 50 for engagement has already been retreated from the guide groove 36 of the guide portion 22, as is illustrated in FIG. 1. At this time, the top of the hook portion 44 provided at the lower end of the eject lever 40 projects into the insertion opening 16.

The edge portion 6 of the printed circuit board 8 then comes to face the insertion opening 16, bringing the groove 5 to a polar key (not shown). The edge portion 6 is pushed down into the insertion opening 16, sliding on the sides of the board 8 along the guide grooves 36 and 66 of the guide portions 22 and 24. The contact portions of the spring contacts 12, which project into the insertion opening 16, are pushed at the edge portion 6 onto the bottom of the groove 13. Due to the bias of the spring portions, the edge portion 6 is pressed, holding the respective contacts in firm contact with the edge portion 6. At the same time, the printed circuit board 8 is mechanically held at the socket 10 via the edge portion 6. Even if great force is applied to the board 8, both sides of the board 8 are guided by the guide grooves 36 and 66 of the guide portions 22 and 24, respectively. The printed circuit board 8 is thereby accurately guided to its desired position without displacement.

The edge portion 6 is fitted in the insertion opening 16. The hook portion 44 of the eject lever 40 is pressed by the edge portion 6. Therefore, the operation portion 42 of the eject lever 40 rotates counterclockwise around the shaft 46. The swelling portions 52 and 54 of the eject lever 40 push the walls 26 and 28 of the guide portion 22 via the protruding portions 37 and 39. The walls 26 and 28 are moved into the holding grooves 37*a* and 39*a*, while being bent in a direction remote from each other.

FIG. 4 shows the socket 10 on which the printed circuit board 8 is mounted in the manner described above. In this state, the projection 50 of the eject lever 40 are held in the groove 4 of the printed circuit board 8. At a glance we can know whether or not the printed circuit board 8 has been inserted into a predetermined position. In addition, the eject lever 40 does not make hindrance to the other instruments on the mother board since almost all of its parts are contained compact in the eject lever container 34 of the guide portion 22 (FIG. 3). The mount density of the mother board can be thereby increased.

To extract the printed circuit board 8 from the socket 10, the finger hook portion 48 of the eject lever 40 is moved outward and the operation portion 42 is rotated clockwise around the shaft 46. The swelling portions 52 and 54 are thereby released from the holding groves 37*a* and 39*a* while pushing the protruding portions 37 and 39 and bending the wall portions 26 and 28. Meanwhile, the hook portion 44 enters the insertion opening 16 (FIG. 1,) from its top, and the lower end portion of the board 8 is pressed from the lower side. The printed circuit board 8 is thereby rotated, elastically deforming the guide arm 64 providing at the other guide portion 24.

FIG. 5 shows the printed circuit board 8 rotated between the guide portions 22 and 24. In this state, more than half of the edge portion 6 of the printed circuit board 8 has been extracted from the insertion opening 16 (FIG. 1). The force of the spring contacts 12 holding the printed circuit board 8 is reduced by half to be considerably small. The printed circuit board 8 can be further rotated, if necessary, and can easily be extracted by one hand in this rotated state. Even if the board 8 is in this rotated state, it can be rotated stably in a common plane and can be prevented by the connection at 68 from being rotated excessively. This is because both sides edges of the board 8 are arranged in the guide grooves 36 and 66 (FIG. 1) of the guide portions 22 and 24 and are guided along these guide grooves 33 and 36.

After the printed circuit board 8 is extracted, the guide arm 64 returns to its initial state by virtue of its elasticity, as shown in FIG. 1.

Therefore, the socket 10 can firmly hold the printed circuit board 8 and can easily release the board 8, simply by hand, though it is simple in structure, having only one eject lever 40.

As is clear from the above, the socket of the present invention, though simple in structure, can firmly hold a printed circuit board and can release the board, by a simple operation.

One of the guide portions may have a container located between a pair of walls and adjacent to a pair of guide rails, for containing the eject lever. In this case, the eject lever can be contained compact in this container, increasing the mount density of the printed circuit board which the socket holds.

Furthermore, when the swelling portions projecting from the operation portion are set in engagement with the protruding portions which project from the wall portions, the structure remains compact even if the printed circuit board is not fitted.

A pair of guide rails may define a guide groove for guiding three surfaces along the sides of the printed circuit board, extending along part of the walls and restricting the rotation of the eject lever. In this case, the sides of the board can be reliably guided, preventing the board from being fixed.

The other guide portion may have a pair of guide rails projecting from a pair of walls, defining a guide groove together with the guide arm. If so, the printed circuit board is readily guided while being extracted from the socket.

The other guide portion may have a connection wall for connecting the pair of walls and a clearance may be provided between the connection wall and the guide arm. If this is the case, the guide arm is prevented from being deformed or damaged excessively.

What is claimed is:

1. A socket for a printed circuit board, comprising:

a header portion having an insertion opening provided between a pair of opposing walls, for allowing a plurality of contacts to project and for receiving the printed circuit board;

a pair of guide portions extending from portions close to longitudinal ends of the insertion opening of the header portion, for guiding sides of the printed circuit board in the inserting and extracting direction thereof;

an eject lever arranged only at one of the guide portions, for extracting one end of the printed circuit board from the insertion opening; and an elastic guide arm arranged only at the other guide portion, for guiding a side of the other end of the printed circuit board, wherein when said eject lever extracts one end of the printed circuit board from the insertion opening, said guide arm is pressed and deflected on the side of the other end of the printed circuit board, to allow the printed circuit board to rotate between the pair of guide portions.

2. A socket according to claim 1, wherein one of said guide portions comprises a pair of walls extending in the inserting and extracting direction of the printed circuit board, a pair of guide rails extending from the walls in opposite directions to guide the sides of the printed circuit board, and an eject lever container arranged outside the guide rails between the walls, and said eject lever comprises an operation portion axially coupled to said walls in the eject lever container and a hook portion provided on a header side of the operation portion to extract the printed circuit board from the insertion opening when the operation portion is rotated.

3. A socket according to claim 2, wherein said eject lever has swelling portions projecting from the operation portion toward the walls, and the swelling portions are held by protruding portions which project from the walls in the opposite directions when the printed circuit board is fitted in the insertion opening.

4. A socket according to claim 2, wherein said pair of guide rails form a guide groove communicating with the insertion opening and guiding the surface along the sides of the printed circuit board, extend along part of said walls and restricting the angle through which the eject lever is rotated.

5. A socket according to claim 1, wherein said other guide portion comprises a pair of walls extending in the inserting and extracting direction of the printed circuit board and defining a gap containing said guide arm, and a pair of guide rails projecting from the walls in the opposite directions and forming, together with the guide arm, a guide groove communicating with said insertion opening.

6. A socket according to claim 5, wherein said other guide portion comprises a connection wall connecting the walls at the side remote from the guide groove, and a clearance is formed between the connection wall and the guide arm.

7. A socket according to claim 1, wherein said other guide portion comprises a pair of walls extending in the inserting and extracting direction of the printed circuit board and defining a gap containing said guide arm, and a pair of guide rails projecting from the walls in the opposite directions and forming, together with the guide arm, a guide groove communicating with said insertion opening.

8. A socket according to claim 7, wherein said other guide portion comprises a connection wall connecting the walls at the side remote from the guide groove, and a clearance is formed between the connection wall and the guide arm.

9. A socket for a printed circuit board, comprising:

a header portion having an insertion opening provided between a pair of opposing walls, for allowing a plurality of contacts to project and for receiving the printed circuit board;

a pair of guide portions extending from portions close to longitudinal ends of the insertion opening of the header portion, for guiding sides of the printed circuit board in the inserting and extracting direction thereof;

an eject lever arranged only at one of the guide portions, for extracting one end of the printed circuit board from the insertion opening; and an elastic guide arm arranged only at the other guide portion, for guiding a side of the other end of the printed circuit board, wherein when said eject lever partially extracts the printed circuit board but still allows the socket to partially engage the printed circuit board, wherein when said eject lever extracts one end of the printed circuit board from the insertion opening, said guide arm is pressed and deflected on the side of the other end of the printed circuit board, to allow the printed circuit board to rotate between the pair of guide portions.

10. A socket for a printed circuit board, comprising:

a header portion having an insertion opening provided between a pair of opposing walls, for allowing a plurality of contacts to project and for receiving the printed circuit board;

a pair of guide portions extending from portions close to longitudinal ends of the insertion opening of the header portion, for guiding sides of the printed circuit board in the inserting and extracting direction thereof;

an eject lever arranged only at one of the guide portions, for extracting one end of the printed circuit board from the insertion opening; and a resilient guide arm arranged only at the other guide portion, for guiding a side of the other end of the printed circuit board, wherein when said eject lever extracts one end of the printed circuit board from the insertion opening, said guide arm is pressed and deflected on the side of the other end of the printed circuit board, to allow the printed circuit board to rotate between the pair of guide portions.

11. A socket according to claim 10, wherein one of said guide portions comprises a pair of walls extending in the inserting and extracting direction of the printed circuit board, a pair of guide rails extending from the walls in opposite directions to guide the sides of the printed circuit board, and an eject lever container arranged outside the guide rails between the walls, and said eject lever comprises an operation portion axially coupled to said walls in the eject lever container and a hook portion provided on a header side of the operation portion to extract the printed circuit board from the insertion opening when the operation portion is rotated.

12. A socket according to claim 11, wherein said eject lever has swelling portions projecting from the operation portion toward the walls, and the swelling portions are held by protruding portions which projects from the walls in the opposite directions when the printed circuit board is fitted in the insertion opening.

13. A socket according to claim 11, wherein said pair of guide rails form a guide groove communicating with the insertion opening and guiding three surface along the sides of the printed circuit board, extend along part of said walls and restrict the angle through which the eject lever is rotated.

14. A socket for a printed circuit board, comprising:

a header portion having an insertion opening provided between a pair of opposing walls, for allowing a plurality of contacts to project and for receiving the printed circuit board;

a pair of guide portions extending from portions close to longitudinal ends of the insertion opening of the header portion for guiding sides of the printed circuit board in the inserting and extracting direction thereof;

an eject lever arranged only at one of the guide portions, for extracting one end of the printed circuit board from the insertion opening; and an elastic guide arm arranged only at the other guide portion, for guiding a side of the other end of the printed circuit board, wherein when said eject lever partially extracts the printed circuit board but still allows the socket to partially engage the printed circuit board, wherein when said eject lever extracts one end of the printed circuit board from the insertion opening, said guide arm is pressed and deflected on the side of the other end of the printed circuit board, to allow the printed circuit board to rotate between the pair of guide portions.

* * * * *